US007302218B2

(12) United States Patent
Ahn et al.

(10) Patent No.: US 7,302,218 B2
(45) Date of Patent: Nov. 27, 2007

(54) IMAGE FORMING APPARATUS WITH CONSTANT CONVEYING VELOCITY

(75) Inventors: Byeong-Hwa Ahn, Seongnam-si (KR); Soo-Yong Kim, Seoul (KR); Gi-Cheol Jeong, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 65 days.

(21) Appl. No.: 11/280,444

(22) Filed: Nov. 17, 2005

(65) Prior Publication Data

US 2006/0263121 A1 Nov. 23, 2006

(30) Foreign Application Priority Data

May 23, 2005 (KR) ..... 10-2005-0043034

(51) Int. Cl.
*G03G 15/20* (2006.01)

(52) U.S. Cl. ..... 399/312; 399/313

(58) Field of Classification Search ..... 399/312, 399/313

See application file for complete search history.

(56) References Cited

U.S. PATENT DOCUMENTS 6,385,427 B1 * 5/2002 Nakane ..... 399/303
6,400,922 B2 * 6/2002 Kakuguchi et al. ..... 399/298
6,873,817 B2 * 3/2005 Park et al. ..... 399/302

FOREIGN PATENT DOCUMENTS

| | | |
|---|---|---|
| JP | 05-289541 | 11/1993 |
| JP | 09-274354 | 10/1997 |
| JP | 10-293437 | 11/1998 |
| JP | 2002-014516 | 1/2002 |
| JP | 2003-043769 | 2/2003 |
| KR | 2003-0070986 | 9/2003 |

* cited by examiner

*Primary Examiner*—David M. Gray
*Assistant Examiner*—Bryan Ready
(74) *Attorney, Agent, or Firm*—Roylance, Abrams, Berdo & Goodman LLP

(57) ABSTRACT

An image forming apparatus includes plurality image carriers sequentially arranged, a conveying belt, which conveys a print medium onto which color-separated images formed on the plurality of image carriers are overlapped, and a plurality of image transfer rollers installed to respectively correspond to the plurality image carriers. The conveying belt is interposed between the image transfer rollers and the image carriers. At least one of the plurality image transfer rollers is arranged to be compressed with a pressure higher than those applied to the other image transfer rollers against the image carriers.

14 Claims, 4 Drawing Sheets

IMAGE FORMING APPARATUS WITH CONSTANT CONVEYING VELOCITY

CROSS-REFERENCE TO RELATED APPLICATIONS

This application claims the benefit under 35 U.S.C. § 119(a) of Korean Patent Application No. 2005-43034, filed May 23, 2005 in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus with an improved construction so that the conveying velocity of a print medium can remain relatively constant.

2. Description of the Related Art

In general, image forming apparatuses are classified into monochromatic image forming apparatuses and color image forming apparatuses. A monochromatic image forming apparatus is an apparatus for forming a black-and-white image using only one color developer, and a color image forming apparatus is an apparatus for forming a color image using colors such as magenta, cyan, yellow and black.

Typically, in an electrophotographic image forming apparatus, a laser beam is scanned by an exposure unit and a latent image is formed on an image carrier electrified to a predetermined potential by an charging unit. The latent image is developed with developers and then transferred to print paper as a visible image while the print paper is fed and conveyed. A conventional color image forming apparatus overlaps transfer respective color-separated images, which are respectively developed on color-separated image carriers, directly onto a print medium. In this case, the print medium passes through plurality color carriers in sequence while being conveyed by a conveying member such as a PTB (Paper Transfer Belt), thereby receiving the overlapped color images.

In addition, the print medium having the overlapped color images pass through a series of image-fixing steps. Then, the print medium is discharged out of the image forming apparatus.

In order to transfer overlapped images directly onto a print medium as described above, it is relatively important to stably convey the print medium. Accordingly, the print medium is charged by the charging unit before it is fed by a paper-feeding roller from a paper feeding device and enters into a firstly located image carrier. The charged print medium moves into close contact with a conveying belt due to static electricity. Therefore, the print medium passes through plurality image carriers in sequence while being conveyed with the conveying belt in close contact with the conveying belt. Therefore, color images are formed on the image carriers and are overlapped onto the print medium. Here, image transfer rollers are mounted on predetermined areas, each corresponding to the image carriers, to provide a predetermined level of transfer pressure for compressing the conveying belt against the image carriers. Thus, the images on the image carriers can be efficiently transferred to the print medium.

With the conventional color image forming apparatus as described above, a print medium fed toward image carriers is subjected to high forces in the conveying direction of the print medium by the transfer rollers. The print medium is charged from the leading edge thereof by the charging unit at the initial entering stage and then the print medium is conveyed in close contact with the conveying belt at the leading edge area thereof. At this time, the paper conveying velocity and the force provided by the conveying belt may be different from those provided by the transfer rollers. Therefore, at the initial stage, where the leading edge area of the print medium starts to come into close contact with the conveying belt, the print medium starts to receive transferred images. The color images may not be correctly transferred to corresponding positions. As a result, color registration may be affected. In particular, because the color image formed on the firstly located color carrier has a large phase as compared to those formed on the other image carriers, the quality of a full-color image may deteriorate.

Accordingly, there is a need for an improved image forming apparatus which conveys a print medium at a relatively constant velocity.

SUMMARY OF THE INVENTION

An aspect of the present invention is to address at least the above problems and/or disadvantages and to provide at least the advantages described below. Accordingly, an aspect of the present invention is to provide an image forming apparatus with an improved construction so that the conveying velocity of a print medium, onto which color images are sequentially and overlapped transferred, can be constantly maintained.

In order to achieve the above-mentioned object, there is provided an image forming apparatus comprising a plurality of sequentially arranged image carriers, a conveying belt which conveys a print medium onto which color-separated images formed on the plurality image carriers are overlapped transferred, and a plurality of image transfer rollers installed to respectively correspond to the plurality image carriers. The conveying belt is interposed between the image transfer rollers and the image carriers. Therefore, at least one of the plurality of image transfer rollers is arranged so as to be compressed with a pressure higher than those applied to the other image transfer rollers against the image carriers.

Here, the plurality of image transfer rollers may be arranged in such a way that with reference to the conveying direction of the print medium, an image transfer roller located at the downstream side is compressed with a relatively lower pressure as compared to an image transfer roller located at the upstream side against the image carriers.

In addition, there may be arranged four image carriers and four image transfer rollers in sequence along the conveying direction of the print medium, and with reference to the conveying direction of the print medium, the image transfer roller located at the most upstream side is compressed with a higher pressure as compared to the other image transfer rollers.

If the plurality of image transfer rollers are referred to as first to fourth image transfer rollers in sequence from the upstream side to the downstream side of the conveying direction of the print medium, the pressure which compresses the first image transfer roller against the corresponding image carrier is higher than the pressure which compresses the second image transfer roller.

In addition, the pressure which compresses the second image transfer roller is higher than the pressure which compresses the third and fourth image transfer rollers.

Here, it is preferable that the pressure which compresses the first image transfer roller is not less than about 2.5 times of the pressure which compresses the third image transfer roller.

It is also preferable that the pressure compressing the second image transfer roller is not less than about 1.5 times of the pressures which compresses the third image transfer roller.

The image forming apparatus may further comprise a compression unit which elastically compresses the ends of the plurality of image transfer rollers.

The compression unit may comprise plurality of axle supporting members to support the axles of the image transfer rollers, respectively, and plurality elastic members to independently and elastically compressing the axle supporting members, respectively.

Here, at least one of the plurality of elastic members may supply an elastic force different in magnitude from those of the other elastic members.

The plurality elastic members may be installed in sequence in such a way that with reference to the conveying direction of the print medium, an elastic member located at the upstream side exerts a higher pressure than any other elastic member located at the downstream side.

The image forming apparatus may further comprise a charging member installed upstream of the plurality image carriers with reference to the conveying direction of the print medium to generate static electricity on the print medium.

The charging member may comprise a charging roller installed so as to move in and out of contact with and rotated by the conveying belt.

Here, the pressure exerted to the most weakly compressed image transfer roller among the plurality of image transfer rollers may be the minimum transfer pressure required to transfer the images of the image carriers.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
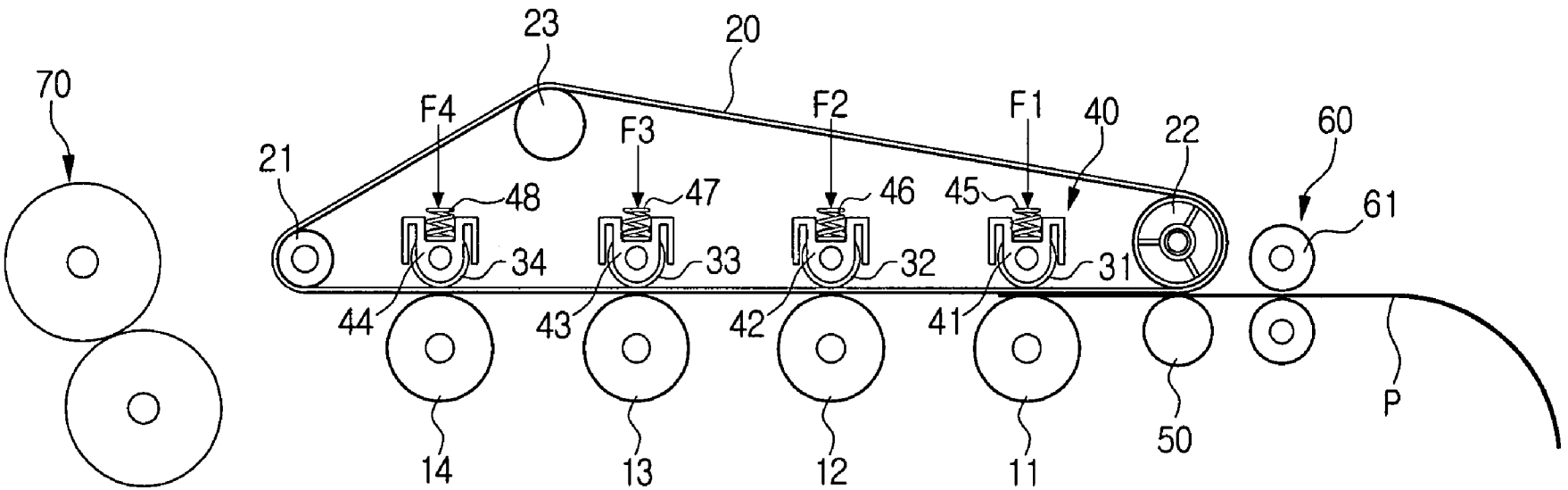
FIG. 1 is a schematic view showing an image forming apparatus according to an embodiment of the present invention.

FIG. 1 is a schematic view showing an image forming apparatus according to an embodiment of the present invention. Referring to FIG. 1, the image forming apparatus according to an embodiment of the present invention comprises plurality image carriers 11-14, a conveying belt 20 for conveying a print medium P for receiving predetermined color images overlapped from the image carriers 11-14, and a plurality of image transfer rollers 31-34 installed to correspond to the image carriers 11-14. The conveying belt is interposed between the image transfer rollers 31-34 and the image carriers 11-14. A compression unit 40 compresses the image transfer rollers 31-34 against the image carriers 11-14 and a charging member 50 charges the print medium P.

The image carriers 11-14 are sequentially arranged in the conveying direction of the print medium P. Color images, which are different from each other, are formed on the surfaces of the image carriers 11-14, respectively, and then overlapped onto the print medium P such as a sheet of printing paper. Therefore, a full-color image can be formed on the print medium P when the print medium P passes through the final image carrier 14. Because the process for forming the images on the surfaces of the above-mentioned image carriers and developing apparatuses can be easily understood from conventional electrophotographic color image forming apparatuses, a detailed description thereof is omitted for clarity and conciseness. In the embodiment of the present invention, four image carriers 11-14 are equally spaced from each other and arranged in such a way that with reference to the conveying direction of the print medium P so that the transfer of yellow (Y), magenta (M), cyan (C) and black (K) colors in sequence from the upstream side to the downstream side is possible.

The conveying belt 20 is supported by plurality supporting rollers 21, 22, 23 and runs along an endless track. Supporting roller 21 is a driving roller for supplying a driving force for moving the conveying roller 20. Roller 22 is a so-called tension roller for tuning the tension of the conveying roller 20. Roller 23 may be an idle roller for guiding the running of the conveying belt 20 while being merely rotationally driven. It should be understood that any suitable sequence or arrangements of the above-identified rollers may be used. The conveying belt 20 is installed so as to move into and out of contact with each of the image carriers 11-14. When the print medium P adheres to the external surface of the conveying belt 20, which is opposite to the image carriers 11-14, by an electrostatic force, the conveying belt 20 serves to guide the print medium P while running with the print medium P. Therefore, the images on the image carriers 11-14 can be transferred to the print medium P.

The print medium P is conveyed along with the conveying belt 20 and the image transfer rollers 31-34 serve to compress the conveying belt 20 against the image carriers 11-14. As a result, the images on the surfaces of the image carriers 11-14 can be readily transferred to the print medium P. The number of image transfer rollers 31-34 corresponds to that of the image carriers 11-14. Thus, in the present embodiment, the image transfer rollers 31-34 comprise a first image transfer roller 31, a second image transfer roller 32, a third image transfer roller 33, and a fourth image transfer roller 34 which are sequentially arranged along the advance direction of the print medium to correspond to the image carriers 11-14, respectively. The first to fourth image transfer rollers 31-34 contact with and are rotationally driven by the conveying belt 20.

The charging member 50 serves to generate static electricity on the print medium P fed from a paper feeding device 60 and includes an charging roller 50 installed to move into contact with and rotated by the conveying belt 20. The charging roller 50 is located upstream of the image carriers 11-14 with reference to the conveyed direction of the print medium P. Therefore, while being introduced between and passing through the charging roller 50 and the conveying belt 20, the print medium P is fed by the paper feeding roller 61 of the paper feeding device 60 to come into close contact with the conveying belt 20 by the electrostatic forces generated by the charging roller 50. Therefore, after passing through the charging roller 50, the print medium P can be conveyed by way of the image carriers 11-14 along with the conveying belt 20 in close contact with the conveying belt 20. In addition, the print medium P with a full-color image is transferred while passing through the image carriers 11-14 and is separated from the conveying belt 20 and conveyed to a fixing unit 70. As is typically known, the fixing unit 70 comprises a heating roller and a compressing roller to apply high temperature and high pressure to the print medium P while the print medium P is passing through a nip formed between them to fix the color image transferred to the surface of the print medium P.

Meanwhile, when the print medium P is in close contact with the conveying belt 20 and is conveyed along with the conveying belt 20, the compression unit 40 controls the pressures applied between the first to fourth image transfer rollers 31-34 and the image carriers 11-14 in such a way that the pressures can be varied from each other. Thus, the inferiority of color registration caused at the initial stage of conveying the print medium P is obviated. This is described in more detail below.

The compression unit 40 includes axle supporting members 41-44 for rotatably supporting the axles of the first to four image transfer rollers 31-34, respectively, and elastic members 45-48 for independently and elastically compressing the axle supporting members 41-44, respectively. Here, for the convenience of description, the elastic members 45-48 are called as first to fourth elastic members according to the located sequence thereof from the upstream side to the down stream side of the conveying direction of the print medium. In addition, each of the first to fourth axle supporting members 41-42 is provided in a pair arrangement, so that it can support the opposite end of corresponding one of the first to fourth image transfer rollers 31-34. Thereby, it is possible to provide each of the first to fourth elastic members 45-48 in a pair arrangement.

In an exemplary embodiment, it is preferable that the first to fourth elastic members 45-48 are compression springs installed to compress the axle supporting members 41-48 against the image carriers 11-14. In addition, at least one of the first to fourth elastic members 45-48 compresses the corresponding rollers with a pressure higher than those exerted by the remaining elastic members. More specifically, a pressure F1 exerted by the first elastic member 45 is higher than the pressure F2 exerted by the second elastic member 46. Moreover, the pressure F2 exerted by the second elastic member 46 is higher than the pressures F3, F4 exerted by the third and fourth elastic members 47, 48. The pressures F3, F4 exerted by the third and fourth elastic members are about equal to each other.

More specifically, it is preferable that the pressure F2 exerted by the second elastic member 46 is not less than about 1.5 times of the pressures F3, F4 exerted by the third and fourth elastic members 47, 48. In addition, it is preferable that the pressure FI exerted by the first elastic member 45 is not less than about 2.5 times of the pressures F3, F4 exerted by the third and four elastic members 47, 48. In this manner, the arrangement is provided in such a way that pressures which gradually decrease from the upstream side to the down stream side of the conveying direction of the print medium P are applied to the image transfer rollers 31-34.

The operation of the image forming apparatus according to the embodiment configured as described above will now be described.

When printing is initiated, a print medium P is fed by the paper feeding roller 61, so that the print medium P is introduced between the charging roller 50 and the conveying belt 20. The printing medium P is electrified by the charging roller 50 from the leading edge thereof and adheres to the conveying belt 20. At the initial stage of conveying the print medium P, the print medium P adheres to the conveying belt 20 only at the leading edge thereof. Therefore, the print medium P typically is not stably secured to the conveying belt 20 because the adhered area is relatively small. Therefore, if the paper feeding roller 61 is close, a feeding force exerted by the paper feeding roller 61 is higher than the adhesion force and the print medium P can be greatly affected. However, if the pressure between the first image transfer roller 31 and the image carrier 11 is set to be higher than a transfer pressure as in the exemplary embodiment of the present invention, the print medium P can be stably secured to the conveying belt 20 by the pressure F1 only when the print medium P passes through the first image transfer roller 31 and the image carrier 11 as shown in FIG. 1.

Figure 2:
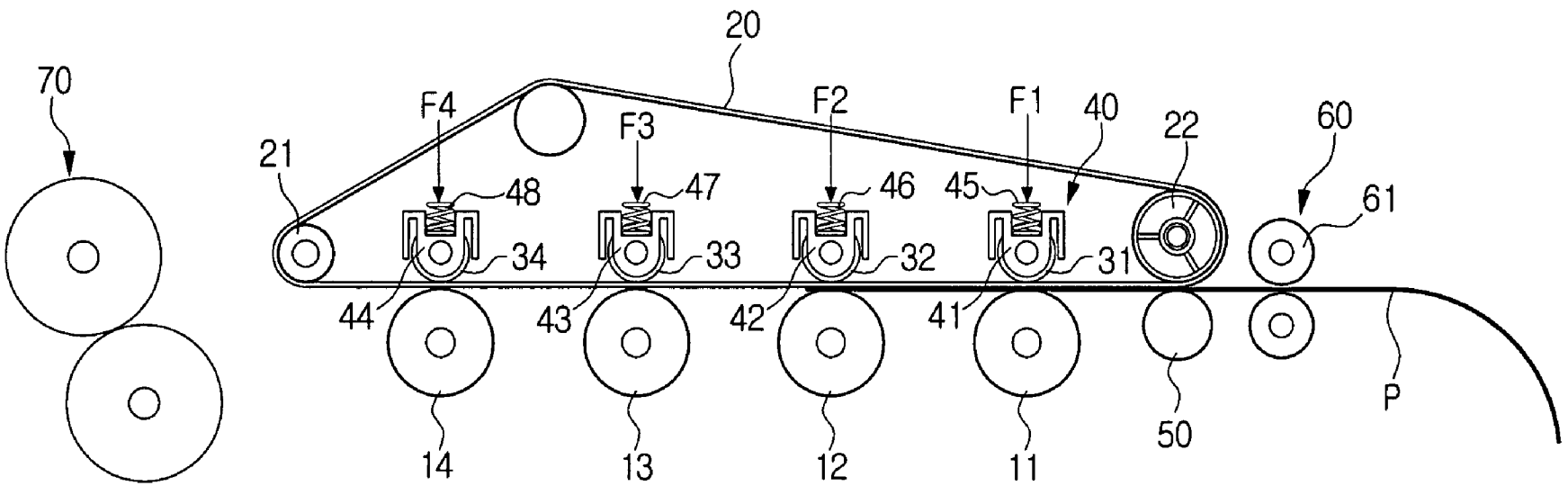
FIGS. 2-3 are schematic views showing the operation of the image forming apparatus of FIG. 1.

Next, at the time when the leading edge of the print medium P passes through the second image transfer roller 32 and the image carrier 12 as shown in FIG. 2, because the adhered area of the print medium P on the conveying belt 20 is increased, the print medium P stably adheres to and is conveyed by the conveying belt 20 even if the second pressure F2 is set to be lower than the pressure F1. Thus, it is possible to prevent the registration of color images transferred from the image carriers 11, 12 from distorting.

Figure 3:
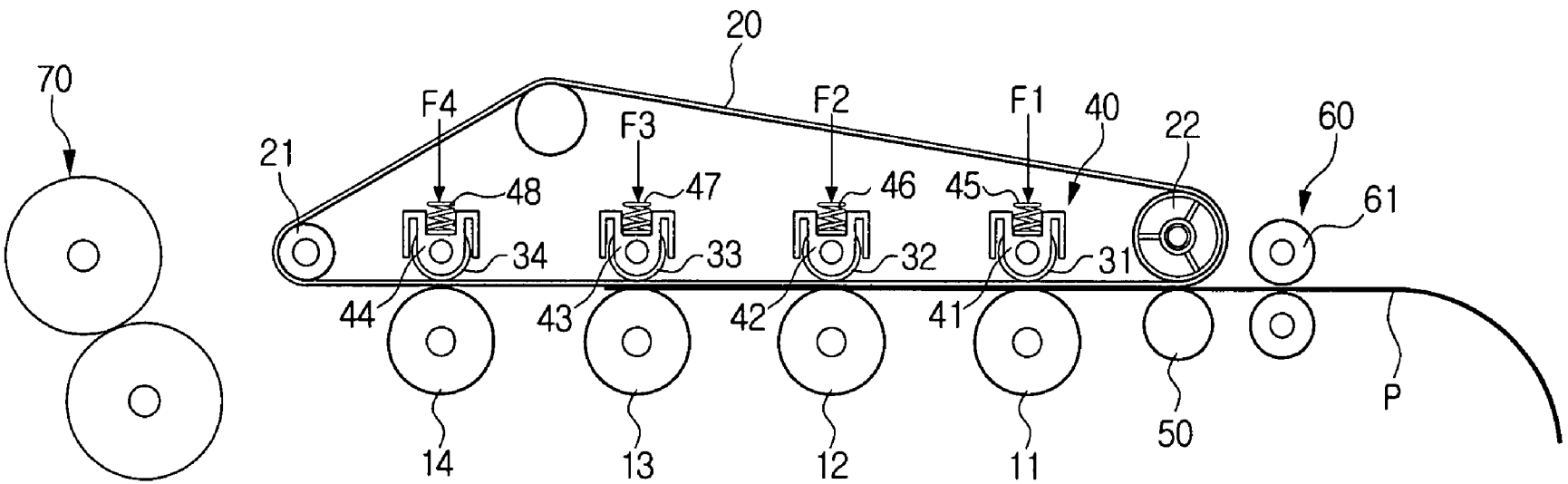

In addition, after the time when the leading edge 31 of the print medium P passes the third image transfer roller 33 and the image carrier 13 as shown in FIG. 3, because the adhered area of the print medium P on the conveying belt is large enough, the print medium P can be stably secured to the conveying belt 20 even if the pressure F3 is set to a level required for an ordinary image-transfer action. Therefore, it is sufficient only if a normal transfer pressure is maintained in a level required for the images on the image carriers 13, 14 by equalizing the pressures F3 and F4.

Figure 4:
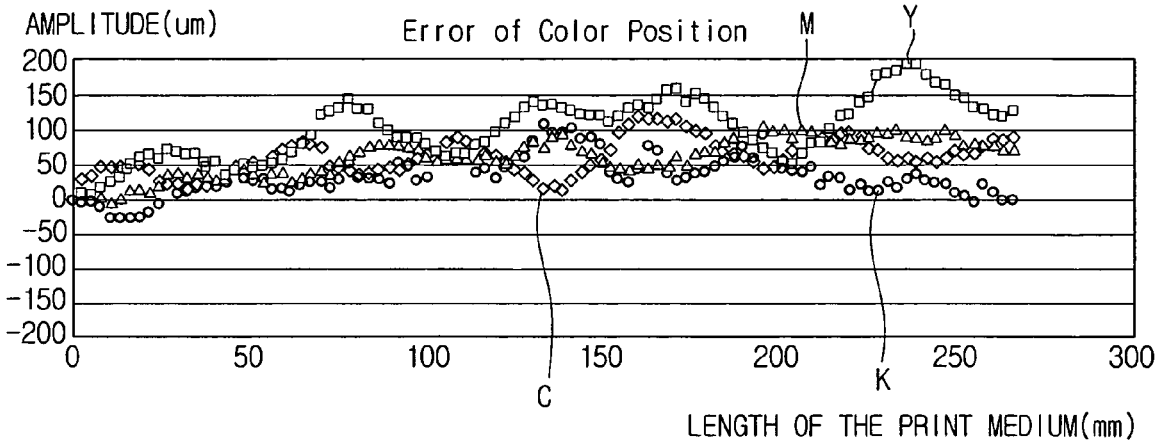
FIG. 4 (PRIOR ART)
FIG. 4 is a graph for describing color registration obtained by a conventional image forming apparatus.
Figure 5:
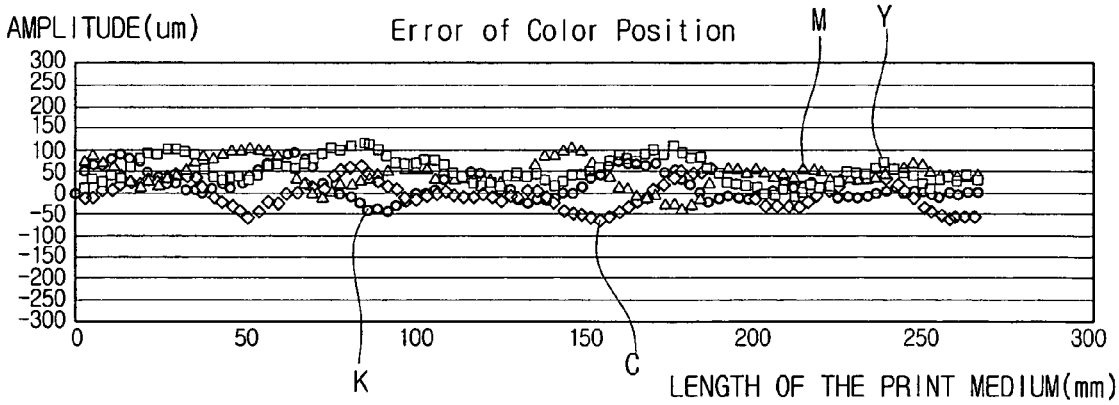
FIG. 5 is a graph showing a result of color registration obtained by the embodiment of the present invention.

Referring to FIGS. 4 and 5, FIG. 4 is a graph showing amplitudes of color-separated images transferred in a state in which all the four pressures F1, F2, F3 and F4 are set to a same level, and FIG. 5 is a graph showing amplitudes of color-spaced images transferred in a state in which the four pressures F1, F2, F3 and F4 are set to be F1>F2>F3=F4. As can be seen from the two graphs, the Y color, which is firstly transferred in the conveying direction of the print medium P, has a relatively large amplitude as compared to the remaining colors (M, C, and K) in FIG. 4 and thus may adversely affect the color registration. However, in FIG. 5, because the four colors are all transferred within a certain level of amplitude, color registration can be enhanced.

As described above, according the exemplary aspects of the image forming apparatus, it is possible to stably secure a print medium to a conveying belt by variously setting the pressures exerted by image transfer rollers when the print medium adheres to and is conveyed by a conveying belt. The image transfer rollers correspond to image carriers, respectively, with reference to the conveying direction of the print medium. Therefore, it is possible to enhance the quality of registration of color-separated images respectively transferred to the print medium from the image carriers.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus, comprising:

a plurality of sequentially arranged image carriers;

a conveying belt which conveys a print medium onto which color-separated images formed on the plurality of image carriers are overlapped; and a plurality of image transfer rollers installed to respectively correspond to the plurality of image carriers with the conveying belt being interposed between the image transfer rollers and the image carriers, wherein with reference to a conveying direction of the print medium, an image transfer roller located at a most upstream side is compressed with a pressure higher than those applied to the other image transfer rollers.

2. An image forming apparatus as claimed in claim 1, wherein if the plurality of image transfer rollers are respectively called as a first to a fourth image transfer rollers in sequence from the upstream side to the downstream side of the conveying direction of the print medium, the pressure which compresses the first image transfer roller against the corresponding image carrier is higher than the pressure exerted to compress the second image transfer roller.

3. An image forming apparatus, comprising:

a plurality of sequentially arranged image carriers;

a conveying belt which conveys a print medium onto which color-separated images formed on the plurality of image carriers are overlapped; and a plurality of image transfer rollers installed to respectively correspond to the plurality of image carriers with the conveying belt being interposed between the image transfer rollers and the image carriers, wherein at least one of the plurality of image transfer rollers is arranged to be compressed with a pressure higher than those applied to the other image transfer rollers against the plurality of image carriers, if the plurality of image transfer rollers are respectively called as a first to a fourth image transfer rollers in sequence from the upstream side to the downstream side of the conveying direction of the print medium, the pressure which compresses the first image transfer roller against the corresponding image carrier is higher than the pressure exerted to compress the second image transfer roller, and the pressure which compresses the second image transfer roller against the corresponding image carrier is higher than the pressures which compresses the third and fourth image transfer rollers.

4. An image forming apparatus as claimed in claim 2, wherein the pressure which compresses the first image transfer roller is not less than about 2.5 times of the pressure which compresses the third image transfer roller.

5. An image forming apparatus, comprising:

a plurality of sequentially arranged image carriers;

a conveying belt which conveys a print medium onto which color-separated images formed on the plurality of image carriers are overlapped; and a plurality of image transfer rollers installed to respectively correspond to the plurality of image carriers with the conveying belt being interposed between the image transfer rollers and the image carriers, wherein at least one of the plurality of image transfer rollers is arranged to be compressed with a pressure higher than those applied to the other image transfer rollers against the plurality of image carriers, if the plurality of image transfer rollers are respectively called as a first to a fourth image transfer rollers in sequence from the upstream side to the downstream side of the conveying direction of the print medium, the pressure which compresses the first image transfer roller against the corresponding image carrier is higher than the pressure exerted to compress the second image transfer roller, and the pressure which compresses the second image transfer roller is not less than about 1.5 times of the pressures which compresses the third image transfer roller.

6. An image forming apparatus as claimed in claim 1, further comprising a compression unit to elastically compress the ends of the plurality image transfer rollers.

7. An image forming apparatus as claimed in claim 6, wherein the compression unit comprises:

a plurality of axle supporting members which support axles of the image transfer rollers, respectively; and a plurality of elastic members to independently and elastically compress the axle supporting members, respectively.

8. An image forming apparatus as claimed in claim 7, wherein at least one of the plurality of elastic members supplies an elastic force different in magnitude from those of the other elastic members.

9. An image forming apparatus, comprising:

a plurality of sequentially arranged image carriers;

a conveying belt which conveys a print medium onto which color-separated images formed on the plurality of image carriers are overlapped;

a plurality of image transfer rollers installed to respectively correspond to the plurality of image carriers with the conveying belt being interposed between the image transfer rollers and the image carriers; and a compression unit to elastically compress the ends of the plurality image transfer rollers;

wherein at least one of the plurality of image transfer rollers is arranged to be compressed with a pressure higher than those applied to the other image transfer rollers against the plurality of image carriers, the compression unit comprises a plurality of axle supporting members which support axles of the image transfer rollers, respectively, and a plurality of elastic members to independently and elastically compress the axle supporting members, respectively, and the plurality of elastic members are installed sequentially in such a way that with reference to the conveying direction of the print medium, an elastic member located at the upstream side exerts a higher pressure than any other elastic member located at the downstream side.

10. An image forming apparatus as claimed in claim 1, further comprising a charging member installed upstream of the plurality of image carriers with reference to the conveying direction of the print medium to produce static electricity on the print medium.

11. An image forming apparatus, comprising:

a plurality of sequentially arranged image carriers;

a conveying belt which conveys a print medium onto which color-separated images formed on the plurality of image carriers are overlapped;

a plurality of image transfer rollers installed to respectively correspond to the plurality of image carriers with the conveying belt being interposed between the image transfer rollers and the image carriers; and a charging member installed upstream of the plurality of image carriers with reference to the conveying direction of the print medium, to produce static electricity on the print medium, wherein at least one of the plurality of image transfer rollers is arranged to be compressed with a pressure higher than those applied to the other image transfer rollers against the plurality of image carriers, and the charging member comprises a charging roller installed to move into and out of contact with and be rotated by the conveying belt.

12. An image forming apparatus as claimed in claim 6, further comprising an charging member installed upstream of the plurality image carriers with reference to the conveying direction of the print medium to produce static electricity on the print medium.

13. An image forming apparatus, comprising:

a plurality of sequentially arranged image carriers;

a conveying belt which conveys a print medium onto which color-separated images formed on the plurality of image carriers are overlapped; and a plurality of image transfer rollers installed to respectively correspond to the plurality of image carriers with the conveying belt being interposed between the image transfer rollers and the image carriers, wherein at least one of the plurality of image transfer rollers is arranged to be compressed with a pressure higher than those applied to the other image transfer rollers against the plurality of image carriers, and the pressure exerted to the most weakly compressed image transfer roller among the plurality of image transfer rollers is the minimum transfer pressure required to transfer the images of the image carriers.

14. An image forming apparatus, comprising:

a plurality of sequentially arranged image carriers;

a conveying belt that conveys a print medium onto which color-separated images formed on the plurality of image carriers are overlapped; and a plurality of image transfer rollers installed to respectively correspond to the plurality of image carriers with the conveying belt being interposed between the image transfer rollers and the image carriers, wherein with reference to a conveying direction of the print medium, a pressure that compresses a most upstream image transfer roller against the corresponding image carrier is higher than a pressure that compresses a second-most upstream image transfer roller against the corresponding image carrier, which is higher than the pressures that compress the remaining image transfer rollers.

* * * * *